United States Patent [19]

Burer

[11] Patent Number: 4,628,968

[45] Date of Patent: Dec. 16, 1986

[54] GUIDE FOR A WEFT-PICKING ELEMENT

[75] Inventor: Franz Burer, Kollbrunn, Switzerland

[73] Assignee: Sulzer Brothers Limited, Winterthur, Switzerland

[21] Appl. No.: 741,002

[22] Filed: Jun. 4, 1985

[30] Foreign Application Priority Data

Jun. 19, 1984 [EP] European Pat. Off. ..... 84107018

[51] Int. Cl.[4] ..... D03D 49/60

[52] U.S. Cl. ..... 139/188 R; 139/439

[58] Field of Search ..... 139/188 R, 190, 192, 139/438, 439

[56] References Cited

U.S. PATENT DOCUMENTS

| | | | |
|---|---|---|---|
| 3,556,163 | 1/1971 | Pfarrwaller | 139/188 |
| 3,667,508 | 6/1972 | Inglin | 139/188 |
| 3,705,605 | 12/1972 | Titou | 139/188 |
| 4,422,482 | 12/1983 | Hintsch | 139/435 |

*Primary Examiner*—Henry S. Jaudon

*Attorney, Agent, or Firm*—Kenyon & Kenyon

[57] ABSTRACT

The guide for the weft-picking element of a weaving machine is formed of alternating supports and hooks which complement one another in pairs to form a guide tooth. Each support is single armed while each adjacent hook widens towards the guide passage in order to form a support surface for the picking element. The construction ensures that a warp yarn which may jump from one lane into another lane through the guide is not overstretched.

3 Claims, 2 Drawing Figures

GUIDE FOR A WEFT-PICKING ELEMENT

This invention relates to a guide for a weft-picking element of a weaving machine.

As is known, weaving machines are generally provided with a guide for a weft-picking element, for example, a gripper projectile, for the picking of a weft yarn into a shed of warp yarns. In some cases, the guides have been constructed of individual supports and guide hooks which are disposed in alternating relationship lengthwise of the guide and which complement one another in pairs to form a guide tooth, for example as described in Swiss Pat. No. 465,521. In such cases, each support has been formed of a pair of arms with one relatively long arm near a reed and a relatively short arm remote from the reed. During a weaving operation, when the guide moves into the shed of warp yarns, the individual warp yarns may cross within the space defined by the two upstanding arms of a support to such an extent that the warp yarn is locally overstretched. This may lead to an imperfection in the woven cloth if not a breakage of the stretched warp yarn.

Accordingly, it is an object of the invention to obviate the risk of overstretching a warp yarn within a weft-picking element guide.

It is another object of the invention to preclude the crossing of individual warp yarns within a guide tooth for a weft-picking element in a weaving machine.

Briefly, the invention provides a guide for a weftpicking element of a weaving machine which is comprised of a plurality of guide hooks and supports disposed in alternating sequentially disposed relation with each guide hook and adjacent support defining a weft-picking element passage. In accordance with the invention, each support is formed of a single arm with a support surface for guiding the weft-picking element thereon while each hook has a neck of widening shape to define a second support surface for guiding the weft-picking element thereon.

Since each support is formed of only a single arm, a crossing over of a warp yarn cannot occur within the contour of the support and, hence, overstretching of a warp yarn can be obviated.

Figure 1:
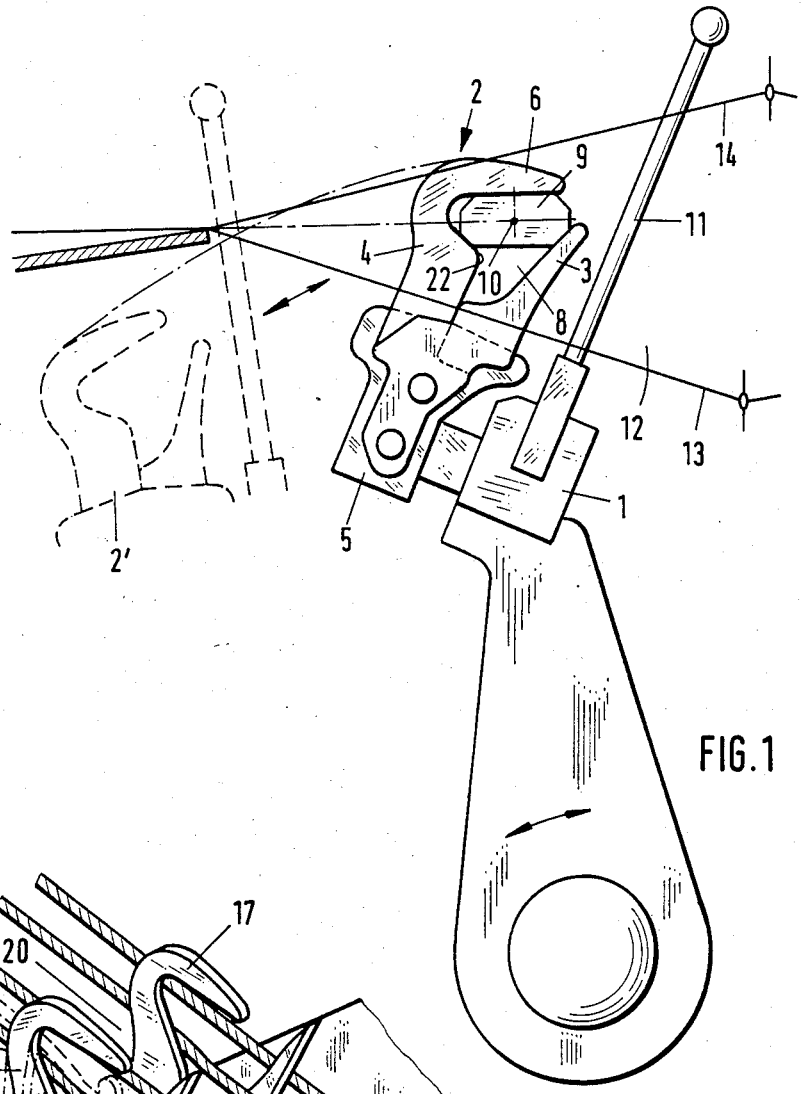
Figure 2:
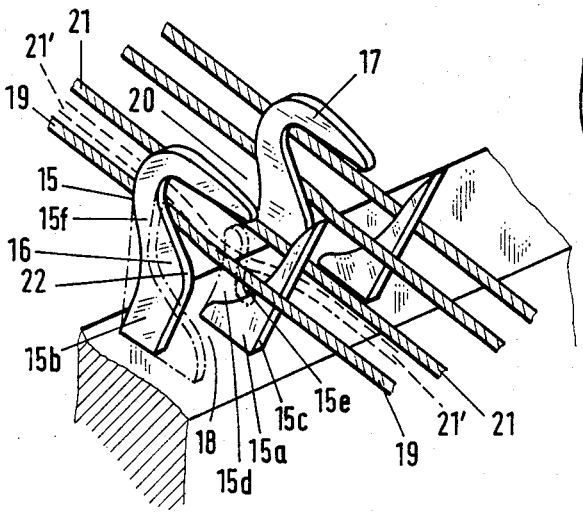

These and other objects and advantages of the invention will become more apparent from the following detailed description taken in conjunction with the accompanying drawings wherein:

FIG. 1 illustrates a side view of a weft-picking element guide constructed in accordance with the invention; and FIG. 2 illustrates a perspective view of a part of the guide of FIG. 1.

Referring to FIG. 1, the guide 2 is mounted on a sley 1 for guiding a weft-picking element, such as a projectile, across the width of a weaving machine. The guide 2 is composed of a plurality of individual supports 3 and guide hooks 4 which are cast in a block 5. As indicated in FIG. 2, the supports 3 and guide hooks 4 are disposed in alternating sequentially disposed relation lengthwise of the guide 2 and complement one another in pairs to form a guide tooth 6 in each case. In addition, each support 3 and adjacent guide hook 4 cooperate to define a weft-picking element passage 8 for a projectile 9 which pulls a weft yarn 10 through the guide 2.

As indicated in FIG. 1, before the weft yarn 10 is beaten-up by a reed 11, the sley 1 with the guide 2 is disposed in a shed 12 formed by warp yarns 13, 14.

After picking of the weft yarn 10, the sley 1 moves the guide 2 to a position 2′ indicated in chain line outside the shed 12.

Referring to FIG. 2, for a better understanding of the invention, the contours of a support 15*a* and of a guide hook 15*b* of a previously known guide tooth 15 are shown in chain-dotted lines. As is apparent, the support 15*a* has two upstanding arms, one relatively long arm 15*c* near to the reed (not shown) and a relatively short arm 15*d* remote from the reed. Thus, a transition in the form of a dip or recess 15*e* is disposed between the arms 15*c*, 15*d*. During picking, a projectile is supported in three places, i.e. on an inside surface of the longer arm 15*c*, on a surface of the shorter arm 15*d* and on a top inside edge of the hook 15*b*. In this regard, the hook 15*b* has a long narrow neck 15*f* so that a substantial internal gap 16 is left inside the guide tooth.

As indicated in FIG. 2, one warp yarn 19 is disposed in a lane 18 of the guide tooth 15 between the hook 15*b* and the support 15*a* while a second warp yarn 21 is disposed in a lane 20 between the guide tooth 15 and the adjacent tooth 17, i.e. between the support 15*a* and the hook of the adjacent tooth 17. During operation, as the sley 1 reciprocates and the guide 2 moves in and out of the shed, the warp yarn 21 from the line 20 may hook behind the shorter arm 15*d* of the support 15*a* and pass through the recess 15*e* into the lane 18 where the correctly moving warp yarn 19 is disposed. This deviant movement is indicated by reference character 21′ and is shown in chain lines. As a result, the deviant warp yarn experiences unwanted overstretching.

In accordance with the invention, the shorter arm 15*d* of the support 15*a* of every tooth 15 is eliminated so that only a single-arm support 15*c* remains near the reed for the projectile. Further, the neck 15*f* of each guide hook 15*b* is widened toward the guide passage 8 and is provided with a support surface 22 for the projectile. These two features ensure that a warp yarn which jumps into an adjacent lane is not overstretched.

Referring to FIG. 1, during passage through the guide teeth of the guide 2, the projectile 9 is supported on three surfaces. That is, each single arm support 3 defines a plane support surface for guiding the projectile 9 while each hook 4 provides two plane support surfaces. As indicated, the neck provides a support surface 22 on a lower side of the projectile 9 while a horizontal top inside surface of the hook provides a support surface for the top side of the projectile 9.

In addition, as indicated in FIG. 2, each hook 4 and adjacent support 3 define a gap therebetween for passage of a single warp yarn therethrough while adjacent guide teeth define another gap for the passage of a single warp yarn therethrough.

The guide has been described above for use in a gripper projectile weaving machine. Of course, the guide may also be used for other types of weaving machines, for example a band gripper weaving machine.

The invention thus provides a guide for weft-picking element in which a crossing over of a warp within the teeth of the guide can be avoided.

Further, the invention provides a guide composed of two-part guide teeth in which overstretching of warped yarn can be obviated.

What is claimed is:

1. A guide for a weft-picking element of a weaving machine, said guide comprising a plurality of guide hooks and supports disposed in alternating sequentially disposed relation, each said guide hook and adjacent support defining a weft-picking element passage, each said support defining a single arm with a support surface for guiding the weft-picking element thereon and each said hook having a neck of widening shape to define a second support surface for guiding the weft-picking element thereon and a second surface to define a third support surface for guiding the weft-picking element thereon.

2. A guide as set forth in claim 1 wherein each support surface is a plane support surface.

3. A guide as set forth in claim 1 wherein each guide hook and adjacent support define a gap therebetween for passage of a single warp yarn therethrough.

* * * * *